US009017111B2

(12) United States Patent
Zheng et al.

(10) Patent No.: US 9,017,111 B2
(45) Date of Patent: Apr. 28, 2015

(54) CONNECTOR WITH A LOCKING LANCE

(71) Applicant: Sumitomo Wiring Systems, Ltd., Yokkaichi, Mie (JP)

(72) Inventors: Song Zheng, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 141 days.

(21) Appl. No.: 13/863,846

(22) Filed: Apr. 16, 2013

(65) Prior Publication Data

US 2013/0288542 A1 Oct. 31, 2013

(30) Foreign Application Priority Data

Apr. 26, 2012 (JP) ..... 2012-101374

(51) Int. Cl.
*H01R 13/428* (2006.01)
*H01R 13/422* (2006.01)
*H01R 13/436* (2006.01)

(52) U.S. Cl.
CPC ..... *H01R 13/4223* (2013.01); *H01R 13/4364* (2013.01)

(58) Field of Classification Search
CPC ..... H01R 13/426; H01R 13/464; H01R 13/4223; H01R 13/4365; H01R 13/4361; H01R 13/4362
USPC ..... 439/744, 595, 752
See application file for complete search history.

(56) References Cited

U.S. PATENT DOCUMENTS

| | | | | |
|---|---|---|---|---|
| 5,554,052 | A * | 9/1996 | Saijo et al. | 439/595 |
| 6,165,011 | A * | 12/2000 | Fukuda | 439/595 |
| 6,948,978 | B2 * | 9/2005 | Itou et al. | 439/595 |
| 7,063,578 | B2 * | 6/2006 | Goto | 439/752 |
| 8,678,866 | B2 * | 3/2014 | Hiraishi | 439/752 |
| 2001/0006861 | A1 * | 7/2001 | Ohsumi | 439/752 |

FOREIGN PATENT DOCUMENTS

JP 7-34569 2/1995

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A locking lance (20) on the inner surface of a cavity (19) of a housing (11) includes a lance main body (21) and an inclined portion (22). The lance main body (21) is cantilevered forward toward the center of the cavity (19) from the inner surface of the cavity (19). The inclined portion (22) is connected to a front part of the lance main body (21) and is narrower than a rear part of the lance main body (21). A first inclined surface (31) of the inclined portion (22) faces the interior of the cavity (19) and inclines away from the center of the cavity (19) to the front. A second inclined surface (32) is opposite the first inclined surface (31), inclines toward the center of the cavity (19) to the front, and is tapered so that the first inclined surface (31) becomes gradually narrower toward the front.

10 Claims, 11 Drawing Sheets

CONNECTOR WITH A LOCKING LANCE

BACKGROUND

1. Field of the Invention

The invention relates to a connector.

2. Description of the Related Art

U.S. Pat. No. 5,554,052 discloses a conventional connector that has a housing formed with a cavity. A resiliently deformable locking lance is cantilevered forward and toward the center of the cavity from the inner surface of the cavity. A terminal fitting is inserted into the cavity from behind and the properly inserted terminal fitting is resiliently retained by the locking lance.

The locking lance can be cut into a shape that avoids interference with the inner surface of the cavity when the locking lance is resiliently deformed. However, the cut front end of the locking lance may be smaller and could be broken if external matter enters the cavity from the front. For example, a retainer may be inserted into the cavity from the front to secure a terminal fitting. However, the locking lance will be in a resiliently deformed state if the terminal fitting is insufficiently inserted in the cavity, and the front end of a small locking lance is likely to be break when it is pushed by the leading end of the retainer. In addition, if the conventional connector is miniaturized and the locking lance is made smaller the force with which the locking lance can hold a terminal fitting is reduced and the terminal fitting may come out of the cavity.

The invention was completed to allow a connector to be miniaturized without affecting the integrity of the locking lance as described above.

SUMMARY OF THE INVENTION

The invention provides a connector with a housing that includes at least one cavity for receiving a terminal fitting. A lance main body is cantilevered forward toward the center of the cavity and resiliently retains the terminal fitting in the proper place within the cavity. An inclined portion is connected to the front end of the lance and includes first and second inclined surfaces. The first inclined surface faces the interior of the cavity, is inclined away from the center of the cavity towards the front and is tapered to become gradually narrower toward the front. The second inclined surface is opposite to the first inclined surface and is inclined toward the center of the cavity to the front.

The invention allows the connector to be miniaturized without affecting the integrity of the locking lance because the first inclined surface faces the interior of the cavity and is connected to the front end of the lance main body and the second inclined surface is formed to avoid the inner surface of the cavity when the lance main body is resiliently deformed. The inclined portion does not interfere with the inner surface of the cavity even if the inner surface of the cavity is not flat because the first inclined surface is tapered. In addition the resiliently deformed lance main body will not be damaged by external matter that enters the cavity from the front because the first inclined surface serves as a barrier between the lance main body and the entering external matter.

A recess may be formed on the inner surface of the cavity facing the second inclined surface. The second inclined surface can then enter this recess. Thus, the housing can be sufficiently smaller while retaining a large amount of the resilient deformation of the lance main body.

A through hole may penetrate the housing in a resilient deforming direction generally at a position facing the lance main body to miniaturize the housing. The through hole may be formed in the housing when certain molds are removed.

A secondary retainer may be mounted into or on the housing from the front and includes a lock projection. The lock projection is fit into and engaged with the front end of the through hole to secure the secondary retainer to the housing. This configuration allows the terminal fitting to be further retained without jeopardizing the simplicity of the housing because the secondary retainer does not require a dedicated locking structure.

The first inclined surface may become wider toward the upper end and/or the first inclined surface may face and substantially contact a projecting piece.

The portion of the lance main body opposite the surface to be engaged with the terminal fitting may slope gradually towards the center of the cavity from a rear part of the lance main body allowing the front end part of the lance main body to be thinned.

The front surface of the lance main body may slope to become gradually more distant from the center for the cavity to the front.

The first inclined surface may have a trapezoidal shape that becomes gradually narrower from the upper or inner end connected to the main inclined surface, to the lower or outer end. The second inclined surface may have a rectangular shape extending from the end connected to the lower end of the first inclined surface while retaining a constant width.

The inclined portion may include at least one rib located in the widthwise middle of a the base of the inclined surface. The rib may extend generally over the entire length of the base inclined surface. The inclined portion preferably includes one or more third inclined surfaces that are widened from opposite side surfaces of the rib to opposite side edges of the first inclined surface.

These and other objects, features and advantages of the invention will become more apparent upon reading the following detailed descriptions of preferred embodiments and accompanying drawings. It should be understood that even though embodiments are separately described, single features thereof may be combined to make additional embodiments.

DETAILED DESCRIPTION OF THE PREFERRED EMBODIMENTS

A connector in accordance with the invention is illustrated in FIGS. 1 to 11 and includes a connector housing 10, a retainer 70 and one or more terminal fittings 90.

Figure 1:
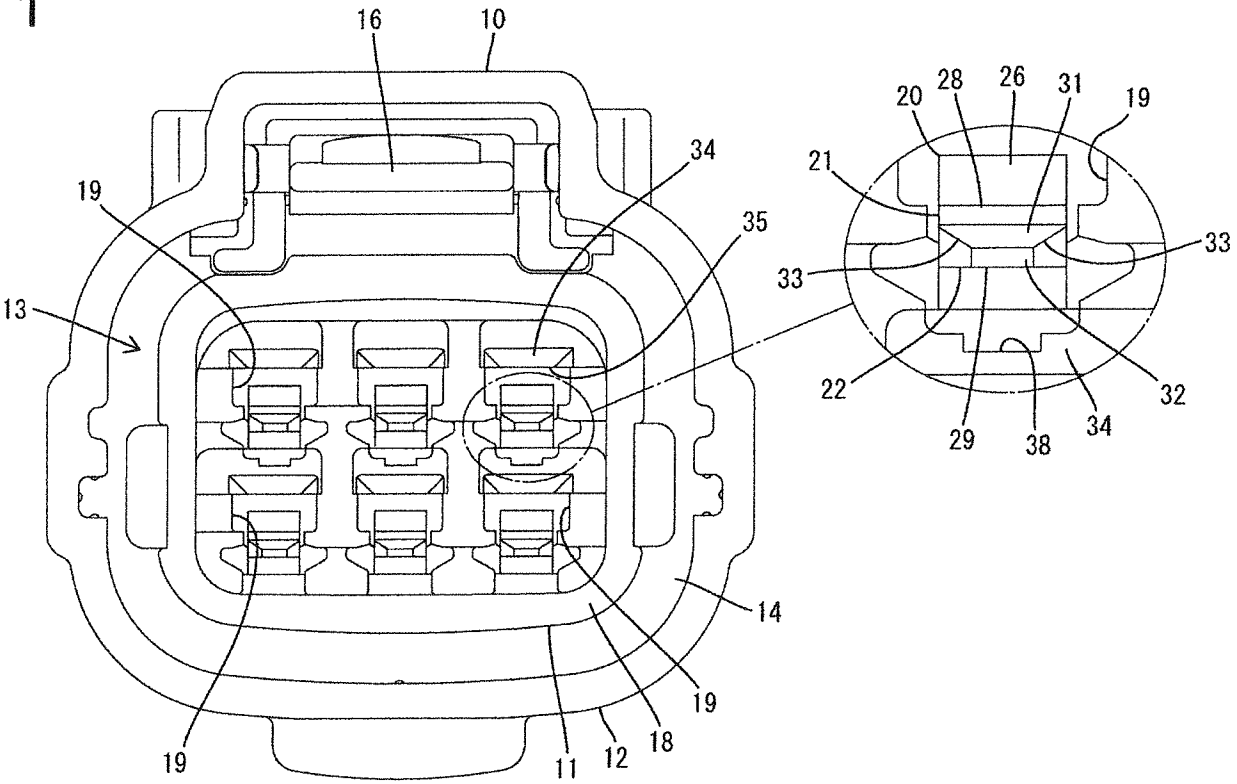
FIG. 1 is a front view of a connector housing in a connector of an embodiment of the present invention.
Figure 6:
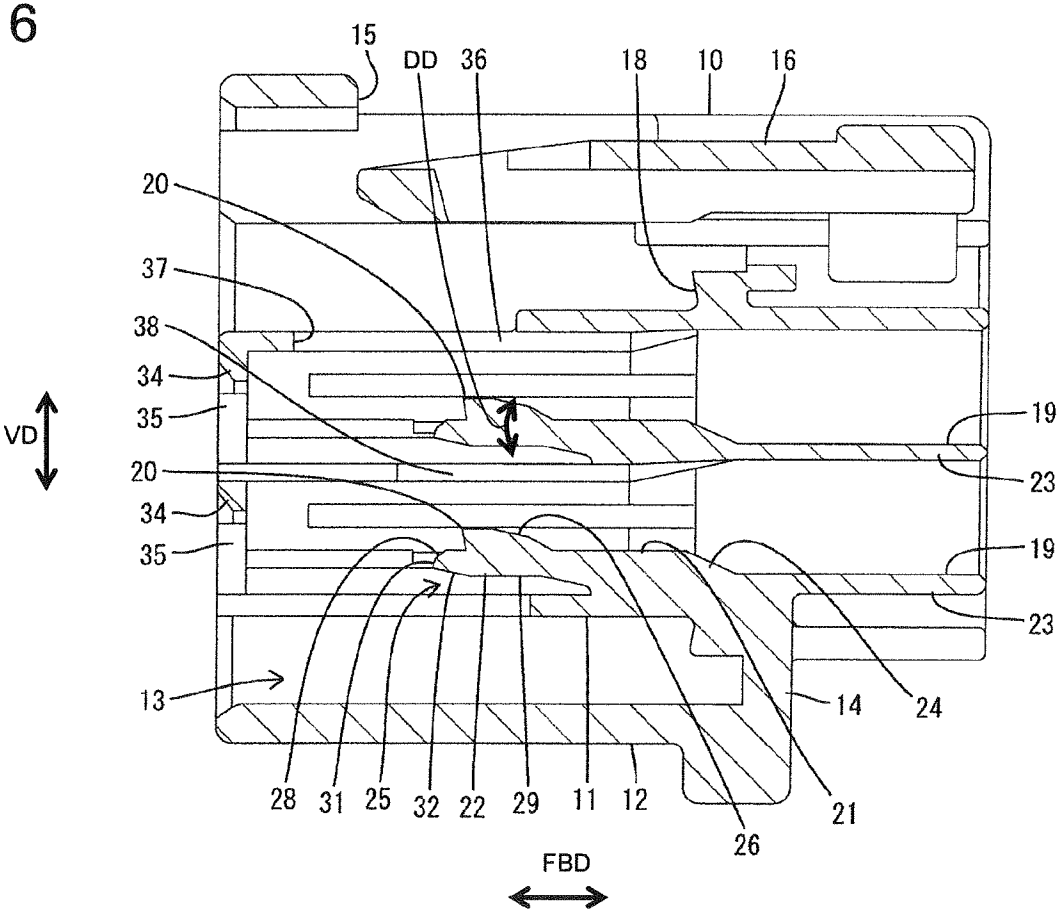
FIG. 6 is a side view in section showing the interior of the connector housing.

The connector housing 10 is made e.g. of synthetic resin and includes a substantially block-shaped housing 11 and a tubular fitting tube 12 at least partly surrounding the housing 11, as shown in FIG. 1. A forwardly open connection space 13 is formed between the housing 11 and the fitting tube 12, as shown in FIG. 6, and can receive an unillustrated mating connector. Further, a coupling 14 couples rear parts of the housing 11 and the fitting tube 12 to each other.

Figure 2:
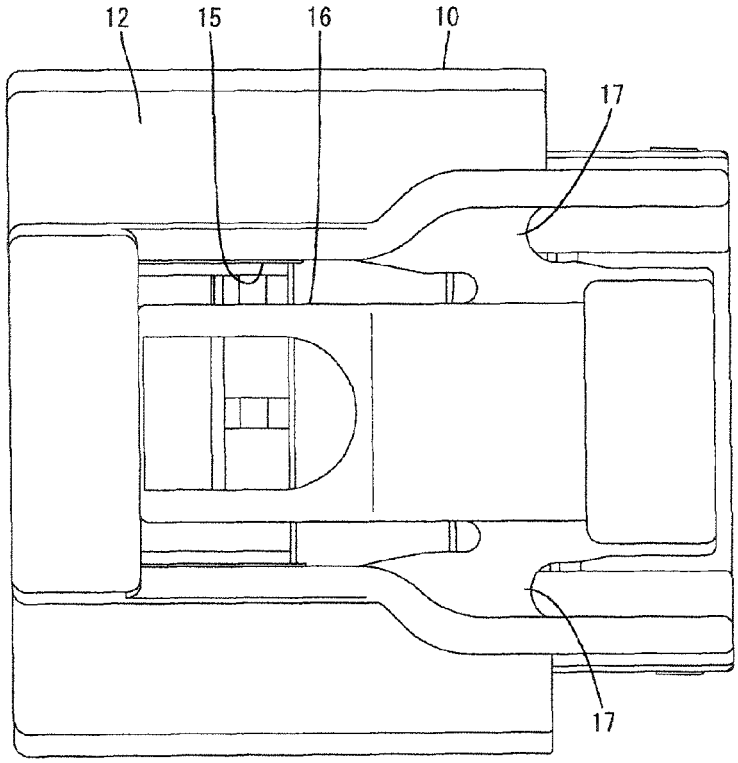
FIG. 2 is a plan view of the connector housing.

As shown in FIG. 2, an opening 15 is formed in the lateral or upper wall of the fitting tube 12 and a lock arm 16 is exposed and arranged in the opening 15. The lock arm 16 is resiliently deformable in a vertical direction VD (direction toward and away from the housing 11 with a pair of supporting portions 17 connected to widthwise ends of the opening 15 as supports. When the connector housing 10 is properly connected to the mating connector, the lock arm 16 is resiliently engaged with an unillustrated lock receiving portion on the mating connector to hold both connectors in a connected state.

Figure 9:
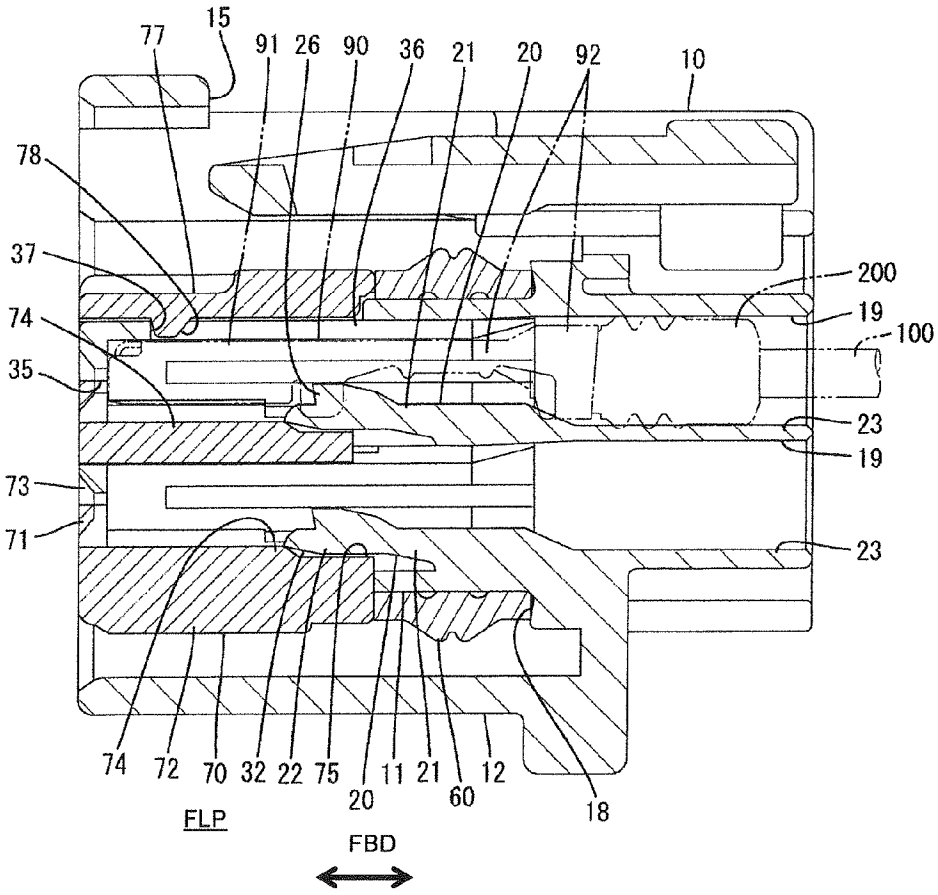
FIG. 9 is a side view in section showing the interior of the connector housing in a state where the retainer is at a full locking position.

As shown in FIG. 6, a step 18 is formed at a position immediately before the coupling 14 on the outer surface of the housing 11 so that a front area of the housing 11 before the step 18 is thinner than a rear area. As shown in FIG. 9, a seal ring 60 made of a resilient material such as rubber is mounted from the front onto the outer circumferential surface of this front area and the retainer 70 is further mounted. The seal ring 60 is positioned in forward and backward directions FBD between the step 18 and the retainer 70 and is resiliently compressed between the outer circumferential surface of the housing 11 and the mating connector to provide a fluid- or liquid-tight seal between the connectors.

As shown in FIG. 6 cavities 19 penetrate the housing 11 in forward and backward directions FBD. As shown in FIG. 1, the respective cavities 19 are aligned and arranged in a plurality of rows in a vertical direction VD and in a plurality of columns in a width direction. The terminal fitting 90 is to be inserted into each cavity 19 from behind.

The terminal fitting 90 is formed by bending, folding and/or embossing an electrically conductive metal plate and includes a connecting portion 91 and a wire connection portion with at least one barrel, as shown in FIG. 9. The connecting portion 91 has a tubular shape into which a tab of an unillustrated terminal fitting mounted in the mating connector is to be inserted. The wire barrel 92 is located behind the connecting portion 91 and is crimped, bent or folded in electrical connection with a core exposed at an end portion of a wire 100 and further is crimped and connected to a resilient rubber plug 200 mounted on an insulation coating at the end portion of the wire 100 behind the part connected to the core.

Figure 3:
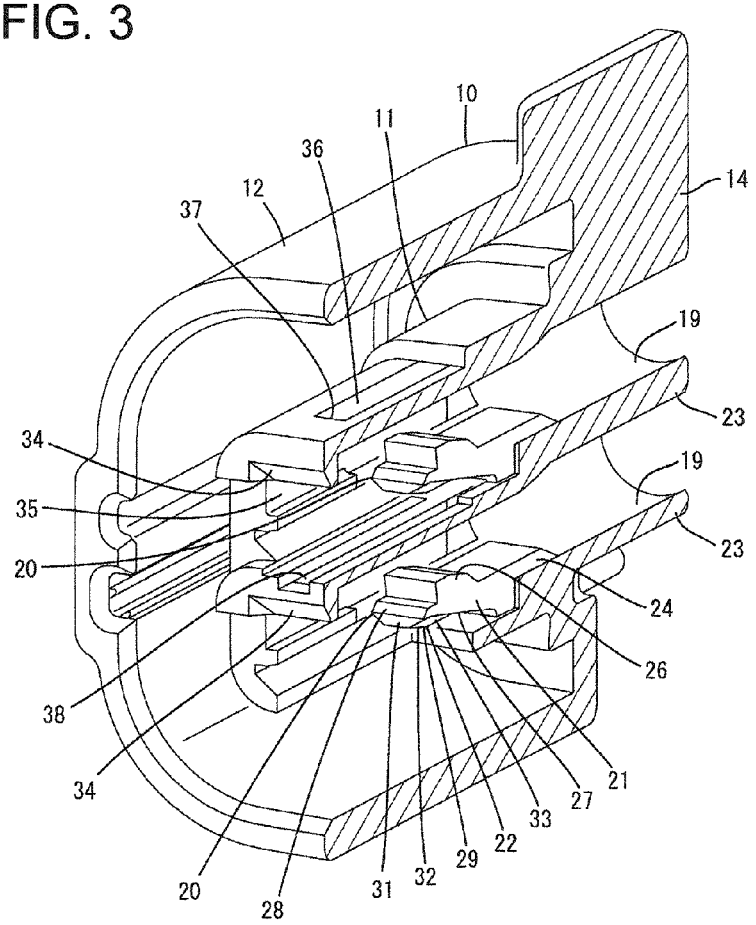
FIG. 3 is a perspective view in section showing the interior of the connector housing when viewed obliquely from above.

Further, as shown in FIG. 3, a locking lance 20 is formed unitarily on the inner surface of the cavity 19 in the housing 11. The locking lance 20 has a lance main body 21 and an inclined portion 22 narrower than the lance main body 21. The lance main body 21 is cantilevered in or up toward the center of the cavity 19 and forward from the inner surface of an inner lower wall 23 of the cavity 19. The lance main body 21 is resiliently deformable in and out along a deforming direction DD intersecting the forward and backward direction FBD and extending substantially a vertical direction VD, with a thick rear end part 24 unitarily coupled to the inner surface of the cavity 19 as a support. The lance body 21 is arranged generally along forward and backward directions FBD in a natural state as shown in FIG. 6. A deformation space 25 is formed between the lance main body 21 and the inner surface of the facing cavity 19 outside of or below the lance main body 21.

Figure 7:
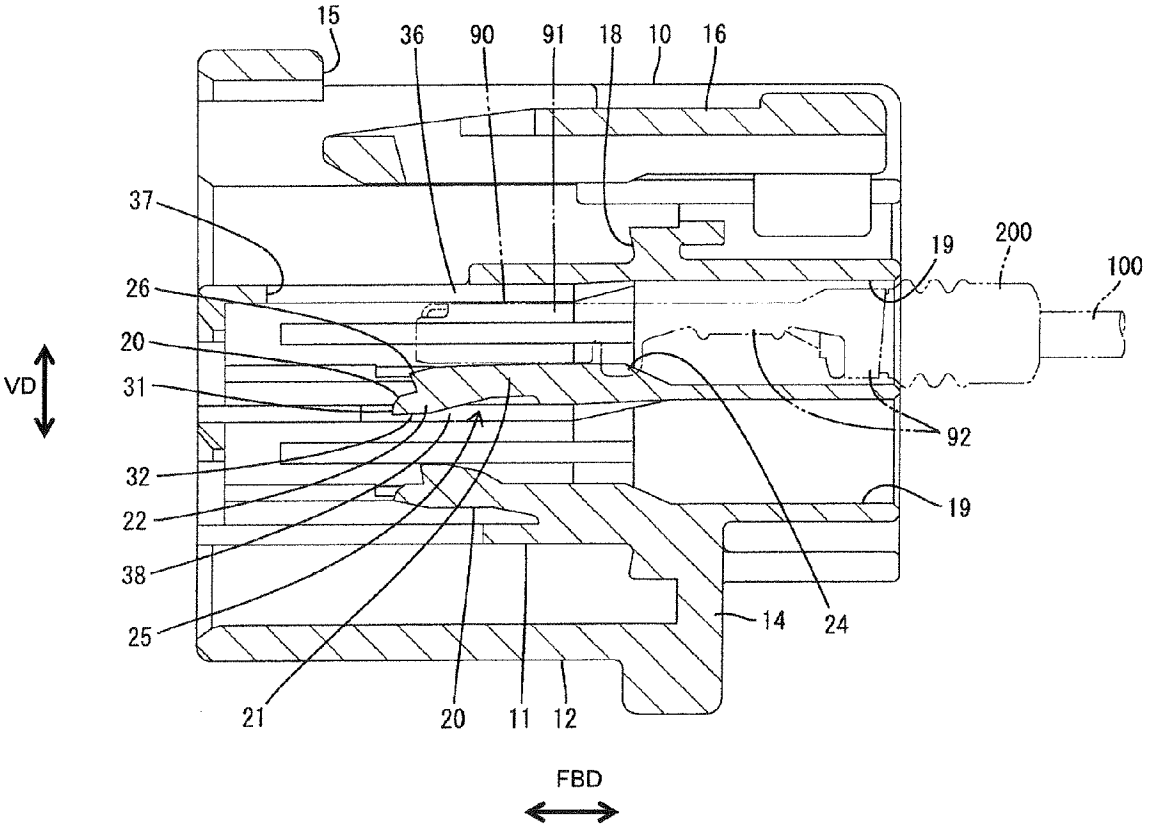
FIG. 7 is a side view in section showing the interior of the connector housing in a state where a locking lance is resiliently deformed.
Figure 8:
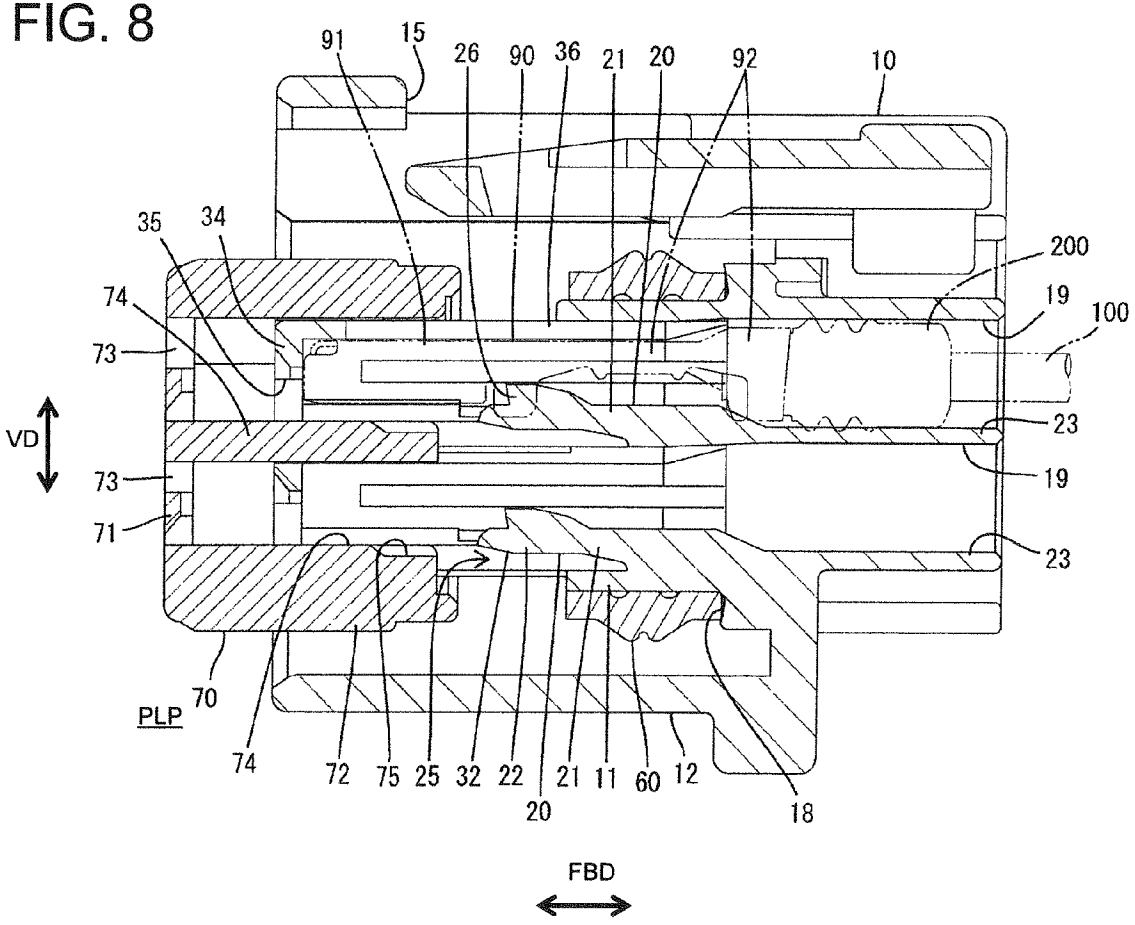
FIG. 8 is a side view in section showing the interior of the connector housing in a state where a retainer is at a partial locking position.

A locking projection 26 projects in or up on a front end part of the lance main body 21. The terminal fitting 90 interferes with the locking projection 26 during insertion into the cavity 19 and the lance main body 21 is resiliently deformed in the deforming direction DD into the deformation space 25 with the rear end part 24 as a support, as shown in FIG. 7. The lance main body 21 resiliently restores when the terminal fitting 90 is properly inserted into the cavity 19, as shown in FIG. 8, and the locking projection 26 engages the connecting portion 91 to hold the terminal fitting 90 in the cavity 19.

As shown in FIGS. 3 and 6, a base inclined surface 27 is formed on the lower surface of the lance main body 21 and opposite the locking projection 26. The base inclined surface 27 is inclined gradually in or up from the rear end part 24 to the front to gradually approach the center of the cavity 19. Thus, the base inclined surface 27 thins the front end part of the lance main body 21. Further, a main inclined surface 28 is formed on the front end surface of the lance main body 21 and is inclined gradually out or down to be gradually more distant from the center of the cavity 19.

Figure 5:
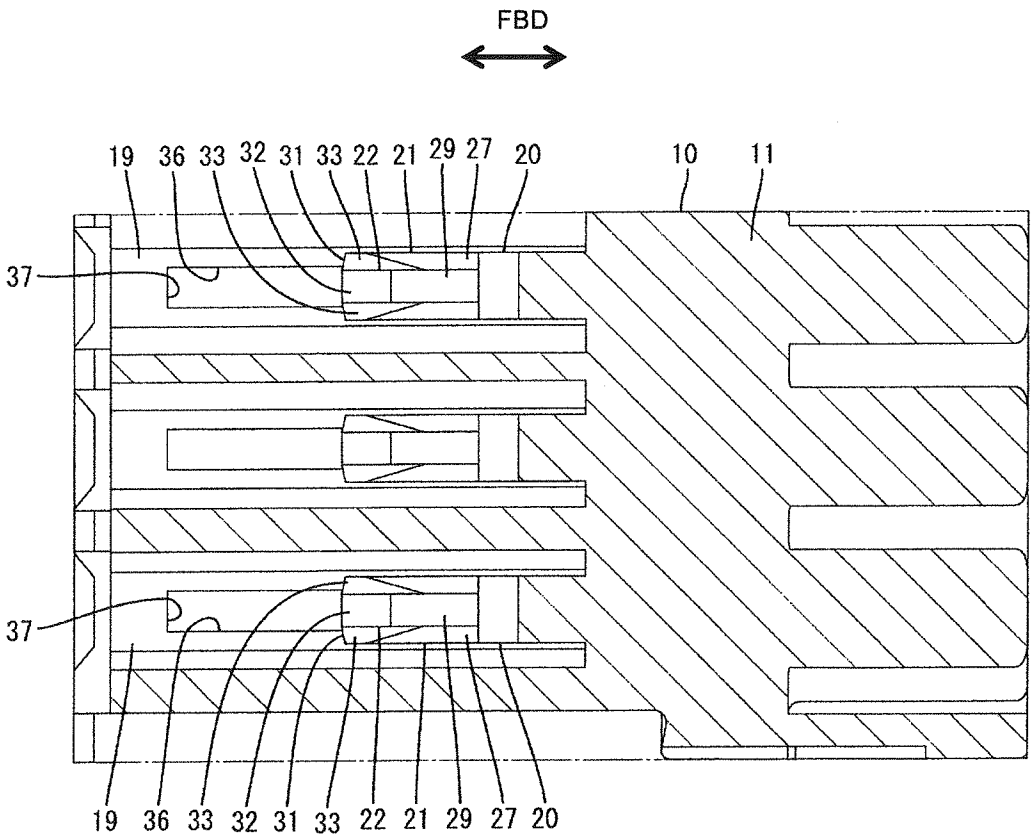
FIG. 5 is a section showing the interior of the connector housing when viewed from below.

As shown in FIGS. 3 and 5, the inclined portion 22 is coupled unitarily to the base inclined surface 27 of the lance main body 21 and includes at least one rib 29 in the form of a rectangular column located in a widthwise intermediate part of the base inclined surface 27 and extending over substantially the entire length of the base inclined surface 27. As shown in FIG. 6, the lower surface of a rear part of the rib 29 is arranged substantially along forward and backward directions FBD when the lance main body 21 is in the natural state.

As shown in FIG. 6, a substantially upper half of the front end surface of the inclined surface 22 defines a first inclined surface 31 that is inclined gradually down or out to the front and away from a side where the locking projection 26 is provided. A substantially lower half of the front end surface of the inclined surface 22 defines a second inclined surface 32 that is inclined gradually up or in to the front and toward a side where the locking projection 26 is provided. The first inclined surface 31 is connected to the lower end of the main inclined surface 28 and is somewhat more steeply inclined than the main inclined surface 28 with respect to forward and backward directions FBD. Further, the second inclined surface 32 is a long and narrow surface connected to the lower end of the first inclined surface 31 and is moderately inclined with respect to forward and backward directions FBD. When the lance main body 21 is resiliently deformed in the deforming direction DD during the insertion of the terminal fitting 90 as shown in FIG. 7, the first inclined surface 31 is arranged substantially along the vertical direction VD and the second inclined surface 32 is arranged substantially along forward and backward directions FBD.

Further, as shown in FIG. 1, the first inclined surface 31 generally has a trapezoidal shape that becomes gradually narrower from the upper or inner end connected to the main inclined surface 28 to the lower or outer end, and specifically has an isosceles trapezoidal shape, when viewed from front. The upper end of the first inclined surface 31 is connected to the lower end of the main inclined surface 28 while having substantially the same width, which is the width of the lance main body 21. On the other hand, the lower end of the first inclined surface 31 is set at the width of the rib 29.

As shown in FIG. 1, the second inclined surface 32 generally has a rectangular shape extending from the upper end connected to the lower end of the first inclined surface 31 to the lower end while having a constant width when viewed from the front. Thus, the width of the second inclined surface 32 generally is equal to that of the rib 29.

As shown in FIG. 5, the inclined portion 22 includes two third inclined surfaces 33 widened from opposite side surfaces of the rib 29 to opposite side edges of the first inclined surface 31. The third inclined surface 33 specifies the width of the first inclined surface 31 and ensures the strength of a front end part of the inclined portion 22. The inclined portion 22 has a tapered shape due to the first inclined surface 31, the second inclined surface 32 and both third inclined surfaces 33 formed on the front end part thereof.

As shown in FIG. 8, a front wall 34 is formed on the front end of the housing 11 for stopping the terminal fitting 90 at a front end position. Further, as shown in FIGS. 1 and 6, a mold removal hole 35 is open below the front wall 34 at the front end of the housing 11. The mold removal hole 35 is formed by the forward passage of an unillustrated mold for forming the locking lance 20 and is located before the locking lance 20.

As shown in FIGS. 3 and 6, through holes 36 vertically penetrate positions of the upper wall of the housing 11 substantially facing the cavities 19 in the upper row. The through holes 36 are formed by the backward passage of a mold for forming the locking lances 20 and are arranged at positions facing the locking lances 20 in the upper row. Further, the through holes 36 substantially extend in forward and backward directions FBD and are open backward. As shown in FIG. 9, the front ends of the through holes 36 serve as locking edges 37 to be resiliently engaged with lock projections 78 of the retainer 70 to be described later.

Figure 4:
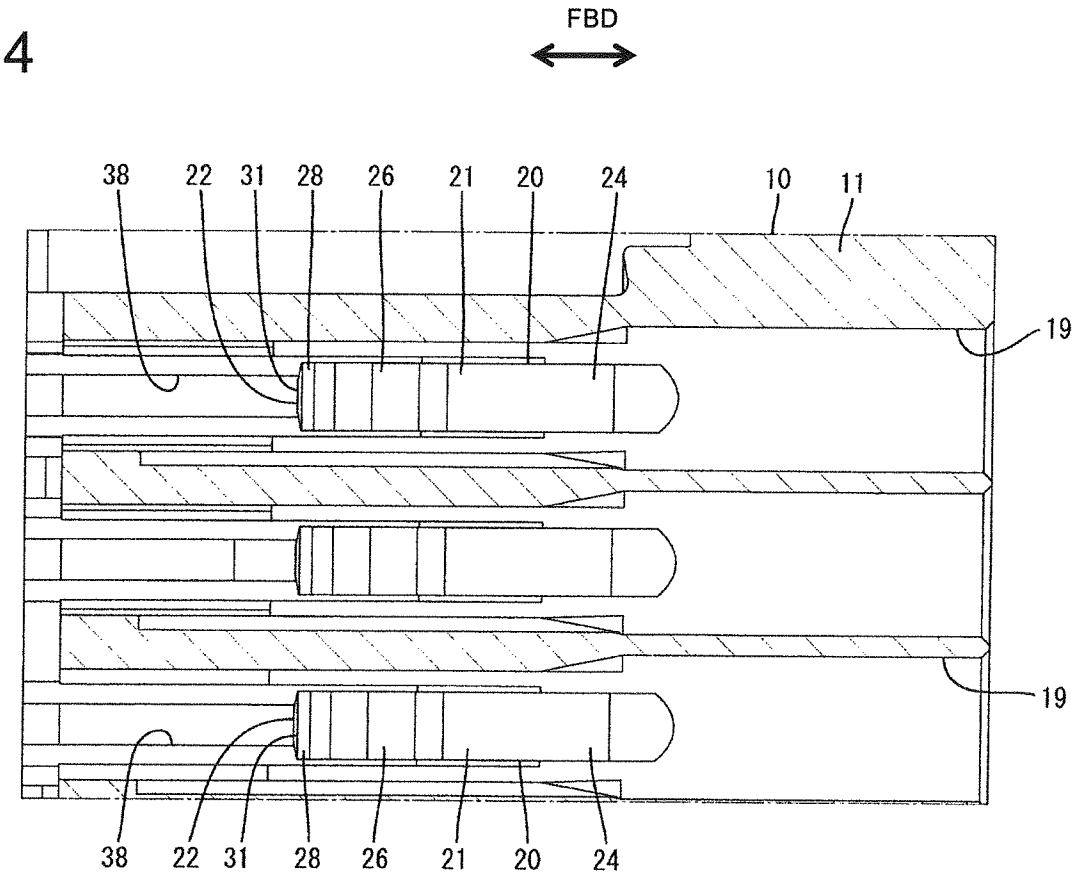
FIG. 4 is a section showing the interior of the connector housing when viewed from above.

As shown in FIG. 3, a recess 38 is formed at a position generally facing the inclined portion 22 of the locking lance 20 on the inner surface of the lower wall 23 of the cavity 19 in the housing 11. The recess 38 vertically penetrates through the lower wall 23 in a generally widthwise central part of the cavity 19 in the upper row and extends in forward and backward directions FBD to open backward. The front surface of the recess 38 is generally closed by the front wall 34. The recess 38 has a size to receive the front end part of the inclined portion 22. The inclined portion 22 enters the recess 38 when the lance main body 21 is resiliently deformed in the deforming direction DD during the insertion of the terminal fitting 90. The inclined portion 22 has a tapered shape as described above. Thus, the recess 38 is sufficiently narrower than the lance main body 21, as shown in FIG. 4.

Figure 10:
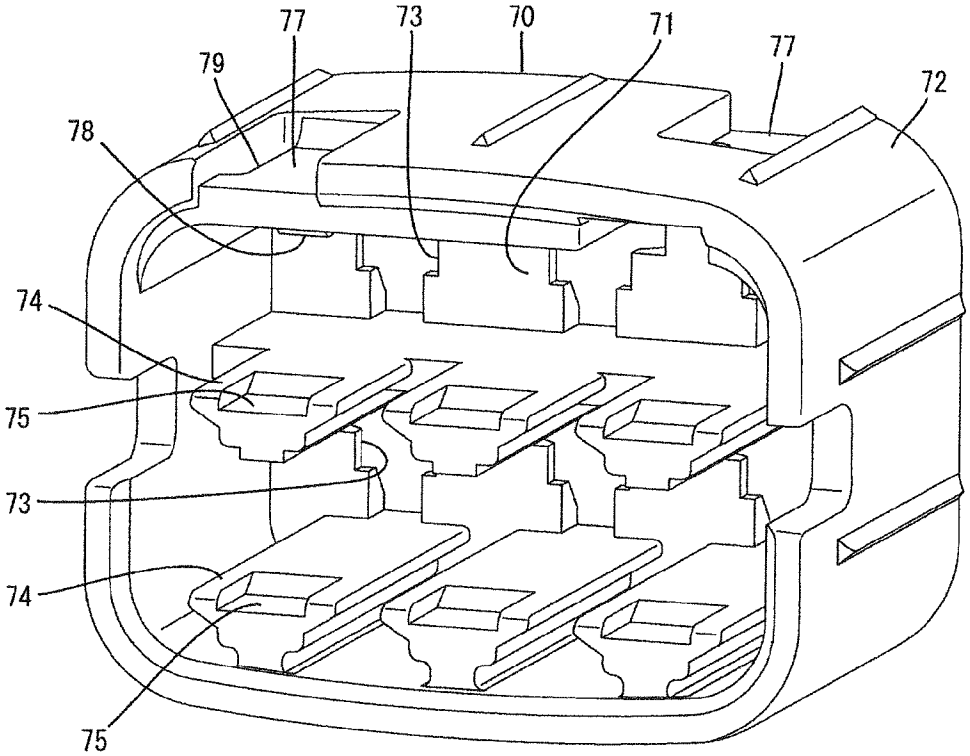
FIG. 10 is a perspective view of the retainer.
Figure 11:
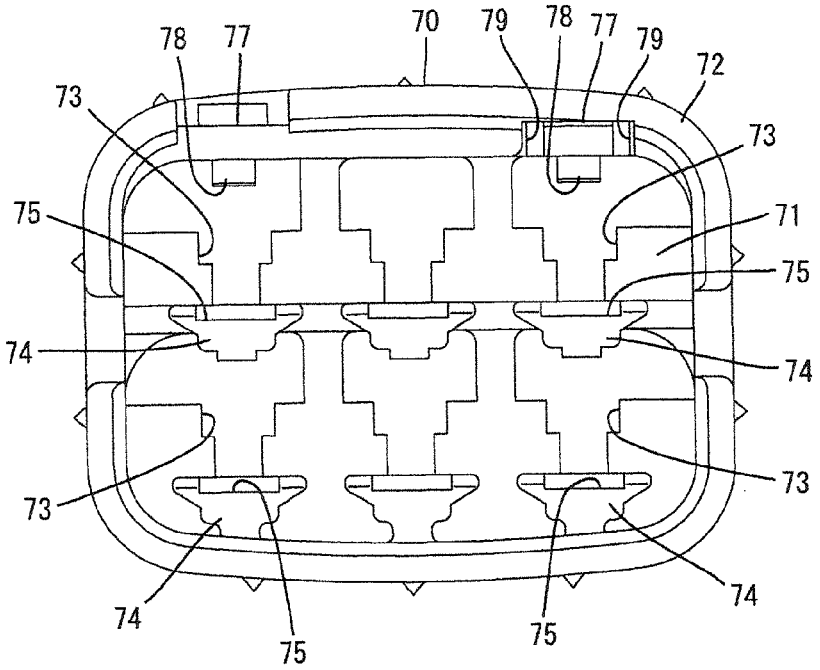
FIG. 11 is a rear view of the retainer.

The retainer 70 is made e.g. of synthetic resin and, as shown in FIGS. 10 and 11, is generally cap-shaped and includes a front plate 71 and a peripheral plate 72 projecting back from the outer peripheral edge of the front plate 71. The retainer 70 is to be mounted into the housing 11 from the front and is movable between a partial locking position PLP shown in FIG. 8 and a full locking position FLP shown in FIG. 9.

The front plate 71 is arranged to at least partly cover the front surface of the housing 11 and includes window holes 73 at positions facing the cavities 19. The tab of the mating terminal fitting is to be inserted into each window hole 73 from the front and is guided into the cavity 19 through each window hole 73. Further, as shown in FIGS. 10 and 11, projecting pieces 74 project on the rear surface (surface facing the housing 11) of the front plate 71. Each projecting piece 74 projects back from the lower edge of the corresponding window hole 73. A bottomed recess 75 is formed on the upper surface of a rear end part of each projecting piece 74. The recess 75 has a rectangular shape when viewed from above and is open at the rear end of the projecting piece 74.

When the retainer 70 is at the partial locking position PLP, as shown in FIG. 8, the front plate 71 is at a distance from the front surface of the housing 11 and the projecting pieces 74 are located before the deformation spaces 25 for the locking lances 20. On the other hand, when the retainer 70 is at the full locking position FLP, as shown in FIG. 9, the front plate 71 is fit to the mold removal holes 35 to form the front end of the housing 11 and the respective projecting pieces 74 are located in the respective deformation spaces 25 for the respective locking lances 20. At this time, the inclined portions 22 of the respective locking lances 20 are fit in the recesses 75 of the respective projecting pieces 74 to restrict resilient deformations and loose movements of the respective locking lances 20.

As shown in FIGS. 10 and 11, two locks 77 are formed on the upper wall of the peripheral plate 72 while being spaced apart in the width direction. The locks 77 are separately arranged on front and rear parts of the upper wall of the peripheral plate 72 and are thinner than a surrounding part. Further, a claw-shaped lock projection 78 projects on the lower surface of the lock 77. The lock 77 is resiliently deformable in the vertical direction VD between slits 79 formed on opposite sides.

When the retainer 70 is at the partial locking position PLP, the lock projection 78 of the rear lock 77 is fit into the through hole 36 and is engageable with the locking edge 37. Further, when the retainer 70 is at the full locking position FLP as shown in FIG. 9, the lock projection 78 of the front lock 77 is fitted into the through hole 36 and engageable with the locking edge 37. In this way, the retainer 70 is retained in the housing 11 both at the partial locking position PLP and the full locking position FLP.

The retainer 70 is at the partial locking position PLP and, in that state, the terminal fitting 90 is inserted into the cavity 19 of the housing 11 from behind. As shown in FIG. 7, the lance main body 21 is deformed resiliently in the deforming direction DD and the inclined portion 22 enters the recess 38 during the insertion of the terminal fitting 90 so that the locking lance 20 does not interfere with the inner surface of the cavity 19. As a result, the amount of resilient deformation of the locking lance 20 can be increased by as the amount that the inclined portion 22 enters the recess 38, and the housing 11 can be made smaller in the height direction (vertical direction VD). In addition, when the lance main body 21 is deformed in the deforming direction DD, the second inclined surface 32 of the inclined portion 22 is substantially parallel to the inner bottom surface of the recess 38 and is retracted from the inner surface of the cavity 19. Thus, the amount of resilient deformation of the locking lance 20 can be increased more and the housing 11 can be made smaller in the height direction.

When the terminal fittings 90 are properly inserted into the cavities 19, the lance main bodies 21 restore resiliently and the locking projections 26 lock the terminal fittings 90. In this way, the terminal fittings 90 are retained primarily in the cavities 19. In that state, the retainer 70 can be pushed to the full locking position FLP. When the retainer 70 reaches the full locking position FLP, the respective projecting pieces 74 enters the deformation spaces 25 and, as shown in FIG. 9, the inclined portions 22 are inserted into the recesses 75 of the respective projecting pieces 74 to restrict resilient deformations of the respective locking lances 20, with the result that the terminal fittings 90 are retained secondarily. Further, the projecting pieces 74 enters the mold removal holes 35 to form the lower walls 23 of the cavities 19. Thus, front end parts of the terminal fittings 90 are supported from below or outside by the projecting pieces 74 and positioned in the cavities 19.

If the terminal fitting 90 is left at an insufficiently inserted position without reaching a proper insertion position in the process described above, the lance main body 21 is kept in a resiliently deformed state as shown in FIG. 7. At this time, the first inclined surface 31 of the locking lance 20 is arranged to substantially face substantially in parallel to the rear surface of the projecting piece 74. Thus, even if it is tried to push the retainer 70 to the full locking position FLP, the rear surface of the projecting piece 74 comes substantially into surface contact with the first inclined surface 31 and any further movement of the retainer 70 is prevented. Accordingly, it can be known that the terminal fitting 90 has not reached the proper insertion position by that the movement of the retainer 90 is prevented. In this case, since the first inclined surface 31 particularly becomes wider toward the upper end and/or is in a positional relationship to substantially face the projecting piece 74, the movement of the retainer 70 can be reliably prevented. Further, since the first inclined surface 31 particularly is substantially in surface contact with the projecting piece 74, the breakage of the inclined portion 22 is avoided.

Further, in withdrawing the terminal fitting 90 from the cavity 19, the retainer 70 is retracted to the partial locking position PLP and, in that state, an unillustrated jig can be inserted into the cavity 19. Then, the jig slides on the main inclined surface 28 of the lance main body 21 and, in some cases, slides on the first inclined surface 31 of the inclined portion 22. This causes the locking lance 20 to be pushed down and out in the deforming direction DD to disengage the locking projection 26 and the terminal fitting 90. By pulling the wire 100 backward in that state, the terminal fitting 90 can be taken out of the cavity 19.

As described above, the narrow inclined portion 22 is connected to the lower surface of the front end part of the lance main body 21 and the second inclined surface 32 of the inclined portion 22 escapes from the inner surface of the cavity 19 when the lance main body 21 is deformed resiliently in the deforming direction DD. Thus, the housing 11 can be miniaturized with the amount of resilient deformation of the lance main body 21 ensured. Particularly, the inclined portion 22 is tapered so that interference with the inner surface of the cavity 19 is avoided more easily.

The retainer 70 is inserted into the cavity 19 from the front while the lance main body 21 is deformed resiliently. Thus, the projecting piece 74 comes substantially into surface contact with the first inclined surface 31. A situation where the inclined portion 22 is broken due to interference with the retainer 70 is avoided in this way.

The through hole(s) 36 are formed in the housing 11 due to the removal of the mold and the front ends of the through holes 36 functions as the locking edges 37 for holding the retainer 70 at the partial locking position PLP and the full locking position FLP. Thus, the configuration of the housing 11 is simplified as compared with the case where a dedicated locking structure is provided in addition to the through holes 36.

The present invention is not limited to the above embodiment and may be embodied as follows.

The first, second and third inclined surfaces may not be straight and may be curved.

The first and second inclined surfaces may not be connected to each other and another surface may be arranged between the first and second inclined surfaces.

The width of the second inclined surface may change in the height direction.

The retainer may include lock projections at positions where the lock projections enter the recesses and are engageable with the front ends of the recesses.

What is claimed is:

1. A connector, comprising:

a housing with at least one cavity for receiving a terminal fitting;

a lance main body cantilevered forward and toward the center of the cavity from an inner surface of the cavity and configured to interfere with the terminal fitting and deform resiliently during insertion of the terminal fitting into the cavity, the lance main body resiliently returning and retaining the terminal fitting when the terminal fitting is inserted properly in the cavity;

an inclined portion connected to a front end part of the lance main body and including first and second inclined surfaces, the first inclined portion being at a position facing the interior of the cavity and inclined farther away from the center of the cavity toward the front, the second inclined surface being at a position substantially adjacent to the first inclined surface and inclined in a direction more toward the center of the cavity to the front and having a tapered shape so that the first inclined surface becomes gradually narrower toward the front; and a recess at a position of the inner surface of the cavity substantially facing the second inclined surface for receiving the inclined portion when the lance main body is resiliently deformed.

2. The connector of claim 1, wherein the inclined portion is narrower than the lance main body.

3. The connector of claim 1, further comprising a base inclined surface on a surface of the lance main body substantially opposite to a surface to be engaged with the terminal fitting and being inclined to gradually approach the center of the cavity to the front from a rear end part of the lance main body so that the front end part of the lance main body is thinned.

4. The connector of claim 1, further comprising a main inclined surface on the front end surface of the lance main body and inclined to be gradually more distant from the center of the cavity to the front.

5. The connector of claim 1, wherein the first inclined surface has a substantially trapezoidal shape, and the second inclined surface has a substantially rectangular shape with a substantially constant width when viewed from the front.

6. A connector, comprising:

a housing with at least one cavity for receiving a terminal fitting;

a lance main body cantilevered forward and toward the center of the cavity from an inner surface of the cavity and configured to interfere with the terminal fitting and deform resiliently during insertion of the terminal fitting into the cavity, the lance main body resiliently returning and retaining the terminal fitting when the terminal fitting is inserted properly in the cavity;

an inclined portion connected to a front end part of the lance main body and including first and second inclined surfaces, the first inclined portion being at a position facing the interior of the cavity and inclined farther away from the center of the cavity toward the front, the second inclined surface being at a position substantially adjacent to the first inclined surface and inclined in a direction more toward the center of the cavity to the front and having a tapered shape so that the first inclined surface becomes gradually narrower toward the front; and a through hole penetrating through the housing at a position substantially facing the lance main body in a resilient deforming direction.

7. The connector of claim 6, further comprising a recess at a position of the inner surface of the cavity substantially facing the second inclined surface for receiving the inclined portion when the lance main body is resiliently deformed.

8. The connector of claim 6, further comprising a retainer mounted to the housing from the front for restricting the resilient deformation of the lance main body and thereby secondarily retaining the terminal fitting, the retainer including a lock projection that is engageable with a front end of the through hole for retaining the retainer in the housing.

9. The connector of claim 8, wherein the first inclined surface becomes wider toward the upper end and is in a positional relationship to substantially face a projecting piece of the retainer, wherein the first inclined surface can come substantially in surface contact with the projecting piece.

10. A connector comprising:

a housing with at least one cavity for receiving a terminal fitting;

a lance main body cantilevered forward and toward the center of the cavity from an inner surface of the cavity and configured to interfere with the terminal fitting and deform resiliently during insertion of the terminal fitting into the cavity, the lance main body resiliently returning and retaining the terminal fitting when the terminal fitting is inserted properly in the cavity; and an inclined portion connected to a front end part of the lance main body and including first and second inclined surfaces, the first inclined portion being at a position facing the interior of the cavity and inclined farther away from the center of the cavity toward the front, the second inclined surface being at a position substantially adjacent to the first inclined surface and inclined in a direction more toward the center of the cavity to the front and having a tapered shape so that the first inclined surface becomes gradually narrower toward the front, wherein the inclined portion includes at least one rib located in a widthwise intermediate part of a base inclined surface and extending substantially over the entire length of the base inclined surface, the inclined portion including third inclined surfaces widened from opposite side surfaces of the rib to opposite side edges of the first inclined surface.

* * * * *